US006796302B2

(12) United States Patent
Butler et al.

(10) Patent No.: US 6,796,302 B2
(45) Date of Patent: Sep. 28, 2004

(54) MIXTURE FITTING FOR A COMBUSTIBLE GAS BURNER SYSTEM

(75) Inventors: Gary Lee Butler, Silver Lake, MN (US); Thomas J. Bachinski, Lakeville, MN (US); Robb Edward Bennett, Prior Lake, MN (US)

(73) Assignee: HON Technology Inc., Muscatine, IA (US)

( * ) Notice: Subject to any disclaimer, the term of this patent is extended or adjusted under 35 U.S.C. 154(b) by 49 days.

(21) Appl. No.: 10/072,459

(22) Filed: Feb. 7, 2002

(65) Prior Publication Data

US 2003/0145848 A1 Aug. 7, 2003

(51) Int. Cl.[7] ..... F24C 5/00

(52) U.S. Cl. ..... 126/512; 126/92 R; 431/125; 431/354

(58) Field of Search ..... 126/92 R, 92 AC, 126/39 R, 512, 500, 91 R, 91 A; 431/354, 352, 343, 355, 125, 126

(56) References Cited

U.S. PATENT DOCUMENTS

| | | | | | |
|---|---|---|---|---|---|
| 1,818,783 | A | * | 8/1931 | Beam | 431/353 |
| 1,961,751 | A | * | 6/1934 | Feyling | 431/349 |
| 2,450,790 | A | | 10/1948 | Greaves | |
| 3,078,915 | A | * | 2/1963 | Webster | 431/354 |
| 3,825,404 | A | * | 7/1974 | De Gouville | 431/354 |
| 3,923,448 | A | | 12/1975 | Guth | |
| 5,213,494 | A | | 5/1993 | Jeppesen | |
| 5,328,356 | A | | 7/1994 | Hawkinson | |
| 5,601,073 | A | | 2/1997 | Shimek | |
| 5,931,661 | A | | 8/1999 | Kingery | |
| 6,053,165 | A | | 4/2000 | Butler et al. | |

FOREIGN PATENT DOCUMENTS

| | | | | |
|---|---|---|---|---|
| DE | 86 31 526.9 | | 10/1987 | |
| FR | 815408 | * | 7/1937 | 431/354 |

OTHER PUBLICATIONS

Declaration of Gary Lee Butler with attached Exhibit A, executed on Jul. 19, 2002.

* cited by examiner

*Primary Examiner*—James C. Yeung
(74) *Attorney, Agent, or Firm*—Merchant & Gould P.C.

(57) ABSTRACT

A mixture fitting for use in a combustible gas system, for example, a fireplace. The mixture fitting may include a first portion configured to be coupled to a combustible gas source and a second portion configured to be coupled to a burner assembly. The first and second portions together form a gas passage. The mixture fitting also includes an air orifice extending from an exposed surface of the mixture fitting to the gas passage. The air orifice is configured to allow primary air to travel through the air orifice and into the gas passage to facilitate mixing of air with the combustible gas. Alternatively, the air orifice may be angled, and multiple air orifices may also be provided.

1 Claim, 7 Drawing Sheets

MIXTURE FITTING FOR A COMBUSTIBLE GAS BURNER SYSTEM

FIELD OF THE INVENTION

The present invention relates to a combustible gas burner system. More particularly, the invention relates to an apparatus for optimizing the mixture of air with a combustible gas in a combustible gas burner system.

BACKGROUND OF THE INVENTION

Many devices combust material to create a flame. For example, a fireplace is an efficient method for providing warmth and creating the appeal of a fire. A gas fireplace combusts a gas, usually LP or natural gas or a mixture thereof, combined with air to create a gas flame. A gas fireplace typically includes a valve assembly that is coupled at a first end to a combustible gas source and at a second end to a burner assembly. The valve assembly functions to control the amount and pressure of combustible gas delivered to the burner assembly. In addition, the valve assembly and/or burner assembly may introduce and mix air with the combustible gas before it is ignited. Prior burner assemblies are shown in U.S. Pat. No. 5,328,356 to Hawkinson and U.S. Pat. No. 5,601,073 to Shimek.

The efficiency of a fireplace can depend upon a variety of factors. Important factors include the relative amounts of air and combustible gas, as well as the degree of mixture of the air and gas, delivered within the fireplace for ignition. Therefore, it is desirable to provide an apparatus that optimizes the amount of air and the mixture of air with combustible gas in a combustible gas burner system to increase efficiency.

SUMMARY OF THE INVENTION

Generally, the present invention relates to a combustible gas burner system. More particularly, the invention relates to an apparatus for optimizing the mixture of air with a combustible gas in a combustible gas burner system.

In one aspect, the invention relates to a mixture fitting for use in a combustible gas system that may include a first portion configured to be coupled to a combustible gas source and a second portion configured to be coupled to a burner assembly, wherein the first and second portions define a gas passage. The mixture fitting may also include an air orifice defined by the mixture fitting extending from an exposed surface of the mixture fitting to the gas passage and configured to allow primary air to travel through the air orifice and into the gas passage.

In another aspect, the invention relates to an apparatus for mixing air with combustible gas including a combustible gas source, and a mixture fitting defining a gas passage and an air orifice extending from an exposed surface of the mixture fitting to the gas passage, wherein the combustible gas source is coupled to the mixture fitting to deliver combustible gas to the gas passage, and wherein the air orifice is configured to provide primary air to the gas passage for mixture with the combustible gas.

In another aspect, the invention relates to a gas fireplace comprising a combustion chamber enclosure defining a combustion chamber and a burner assembly disposed within the fireplace, wherein the burner assembly includes a burner disposed to combust a combustible gas and air mixture within the combustion chamber, wherein the burner defines a burner tube aperture, a burner tube coupled to the burner tube aperture, and an air shutter coupled to the burner tube. The fireplace further includes a mixture fitting defining a gas passage and an air orifice, wherein combustible gas is delivered through the gas passage and mixed with primary air entering the gas passage through the air orifice to form the combustible gas and air mixture and wherein the mixture fitting is configured to deliver the combustible gas and air mixture to the burner through the burner tube.

In yet another aspect, the invention relates to a method for the mixing of combustible gas and air including steps of: providing a combustible gas source; and providing a mixture fitting that defines a gas passage and an air orifice oriented at an angle in a direction of a normal flow of the combustible gas, wherein the combustible gas source delivers combustible gas to the gas passage and wherein the air orifice provides primary air to the gas passage for mixture with the combustible gas.

Another aspect of the invention relates to a method for generating a combustible gas and air mixture in a gas fireplace including the steps of: supplying combustible gas from a combustible gas source; conducting the combustible gas from the combustible gas source to a mixture fitting, wherein the mixture fitting defines a gas passage and an air orifice; passing the combustible gas through the gas passage; providing primary air into the gas passage through the air orifice; mixing the air with the combustible gas within the gas passage to form the combustible gas and air mixture; and directing the combustible gas and air mixture from the mixture fitting.

The above summary of the present invention is not intended to describe each disclosed embodiment or every implementation of the present invention. Figures in the detailed description that follow more particularly exemplify embodiments of the invention. While certain embodiments will be illustrated and describing embodiments of the invention, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

While the invention is amenable to various modifications and alternant forms, specifics thereof have been shown by way of example and the drawings, and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENTS

The invention is applicable to a combustible gas burner system. In particular, the invention is directed to an apparatus for optimizing the addition and mixture of air with a combustible gas in a gas burner system. While the present invention is not so limited, an appreciation of the various aspects of the invention will be gained through a discussion of the examples provided below.

Embodiments of the present invention may be used in conjunction with any system or apparatus that ignites a combustible gas to generate a gas flame. A non-exhaustive list of such devices may include fireplaces, grills, furnaces, stoves, appliances, etcetera. While the example embodiments of the present invention provided below are described in conjunction with an example fireplace, the present invention is equally applicable to other systems or apparatuses besides a fireplace that ignite a combustible gas to generate a gas flame.

As used herein, the term "coupled" means any structure or method that may be used to provide connectivity between two or more elements, which may or may not include a direct physical connection between the elements. The terms "efficiency" or "more efficient" are used herein to mean either an increase in temperature for combustion of a given volume of gas or a decrease in an amount of gas needed to generate a given temperature.

Figure 1:
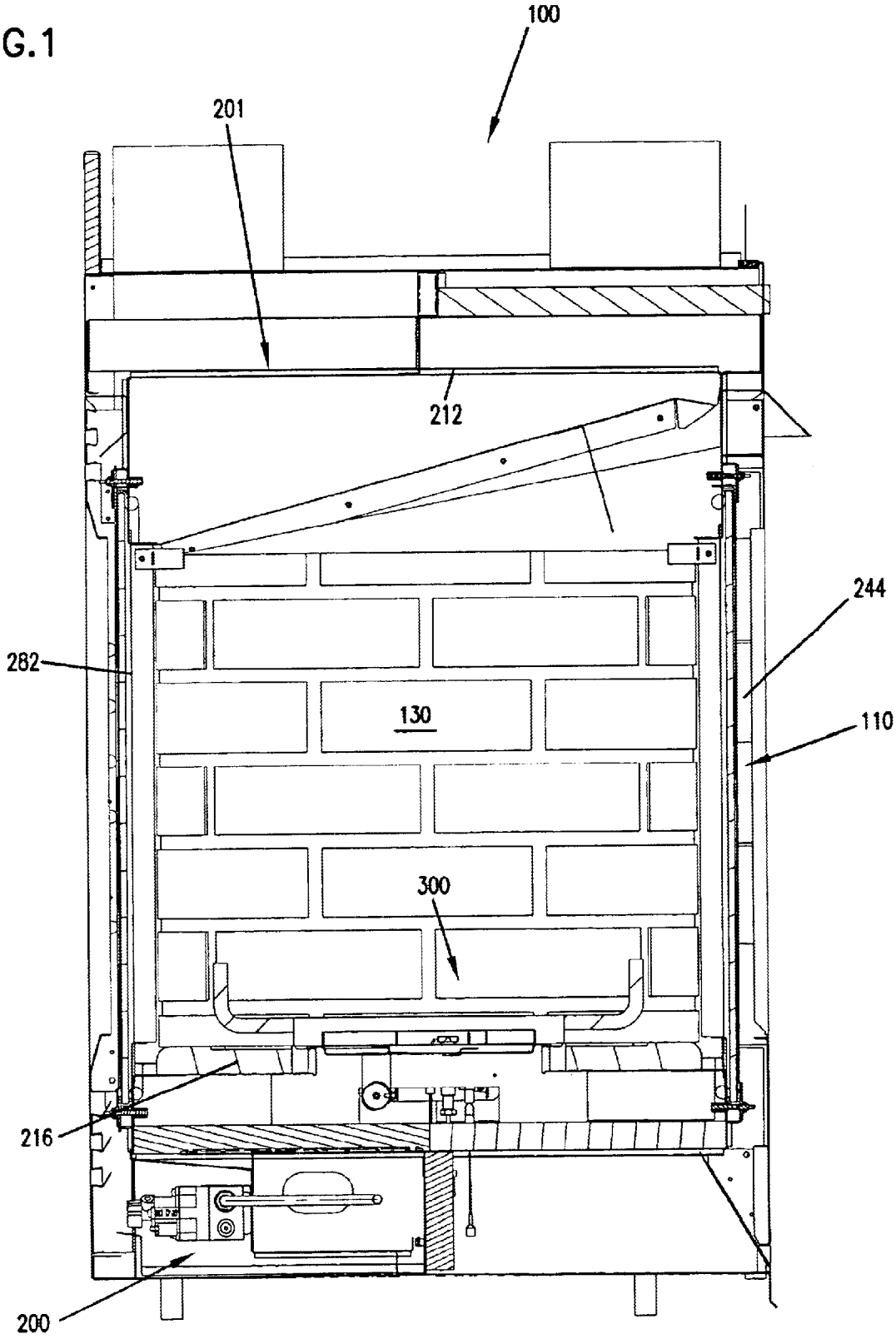
FIG. 1 is a side schematic cross-sectional view of an example embodiment of a fireplace.
Figure 2:
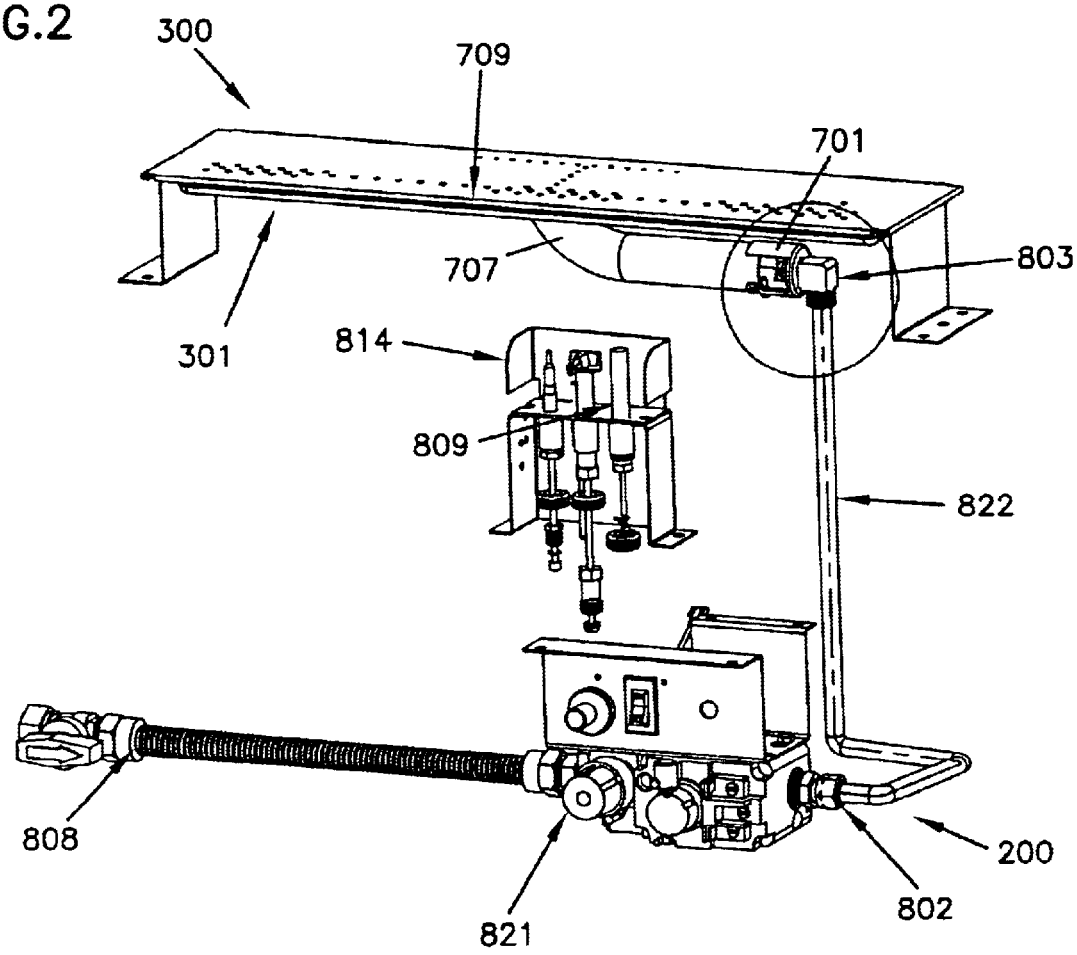
FIG. 2 is a perspective schematic view of example embodiments of a valve assembly and a burner assembly of the fireplace of FIG. 1 including an example embodiment of a mixture fitting made in accordance with the present invention.
Figure 3:
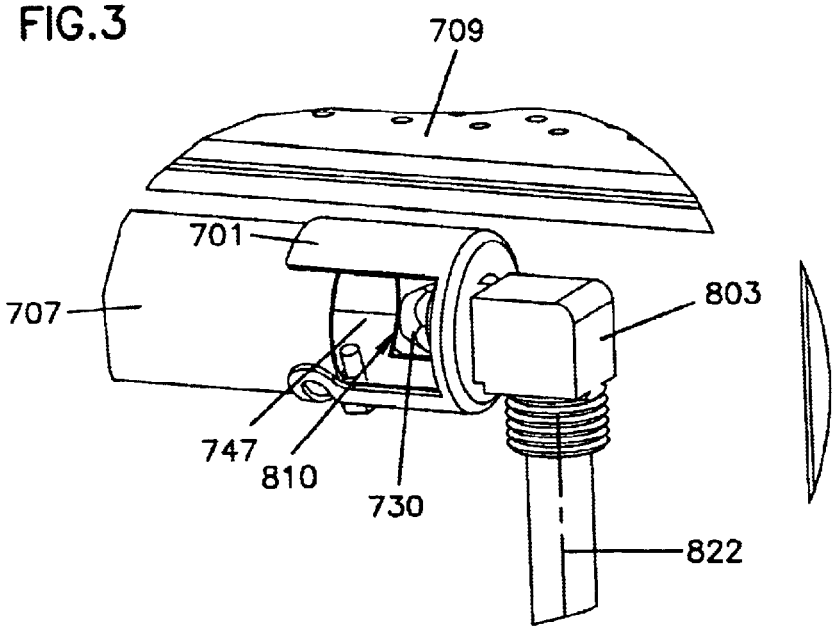
FIG. 3 is an enlarged perspective view of a portion of the example valve and burner assemblies of FIG. 2 including the example embodiment of the mixture fitting.
Figure 4:
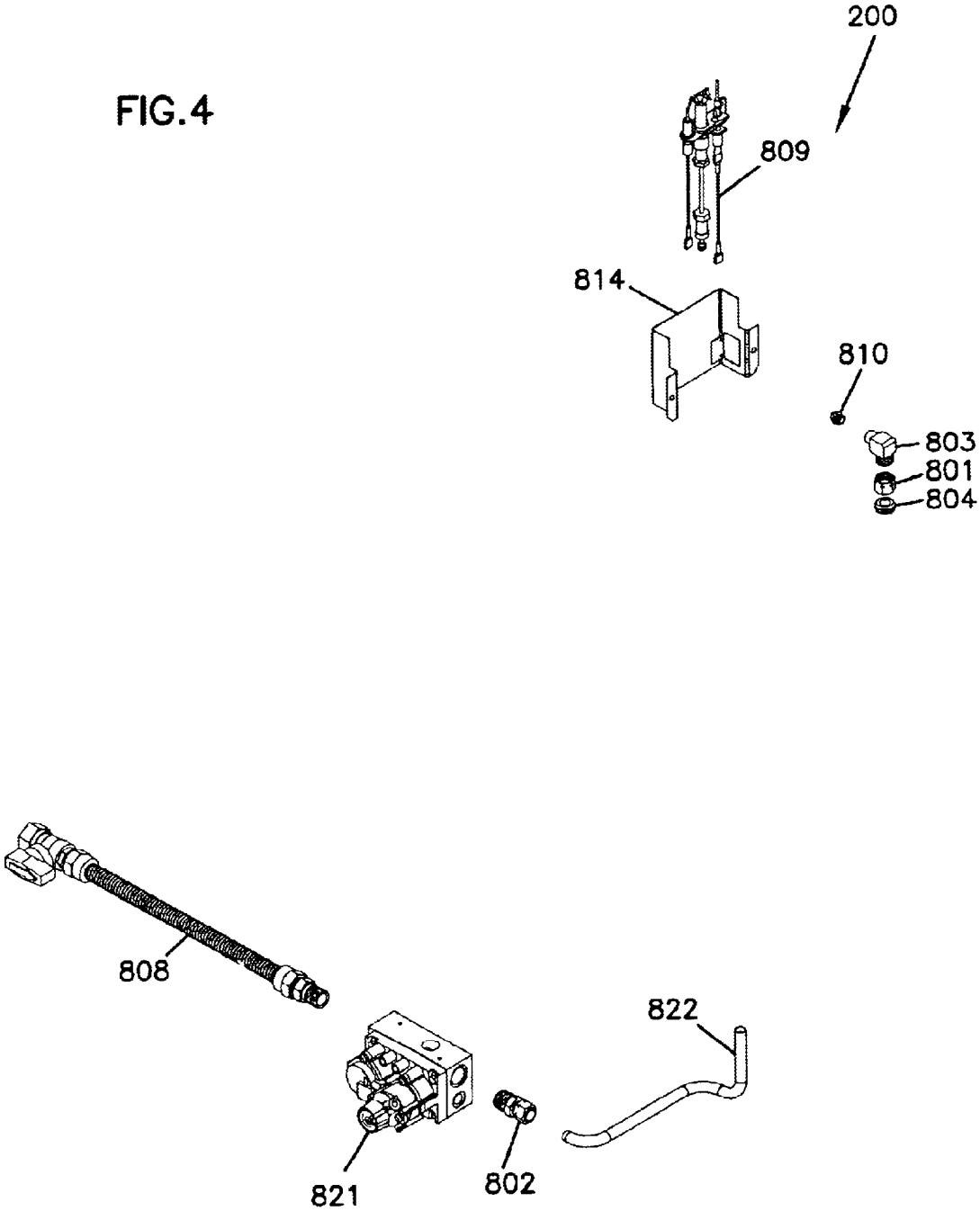
FIG. 4 is an exploded perspective schematic view of the example valve assembly of FIG. 2.
Figure 5:
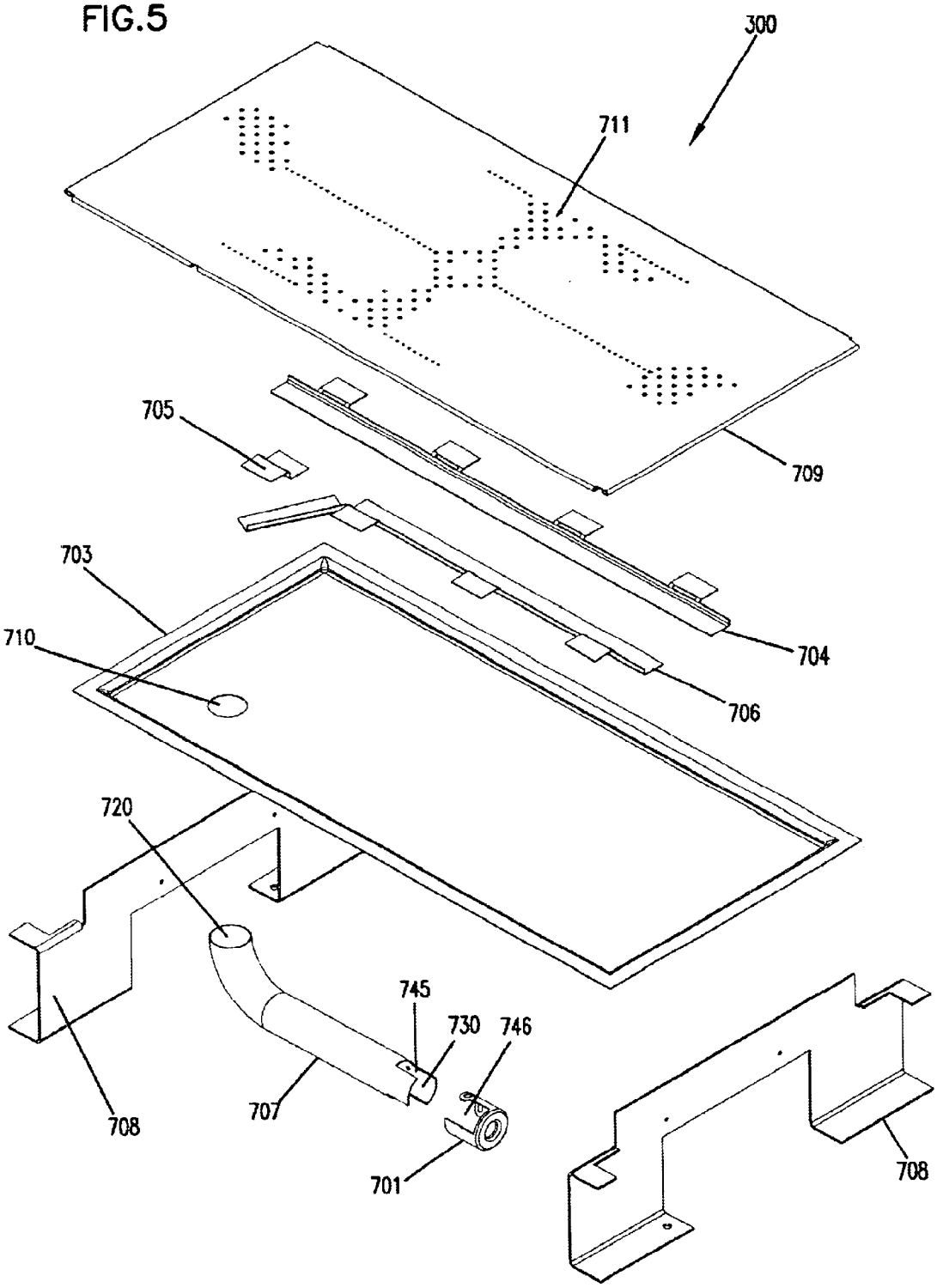
FIG. 5 is an exploded perspective schematic view of the example burner assembly of FIG. 2.
Figure 7:
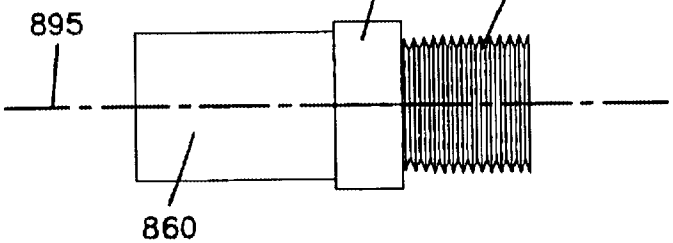
FIG. 7 is a side view of the example embodiment of the mixture fitting of FIG. 6.
Figure 6:
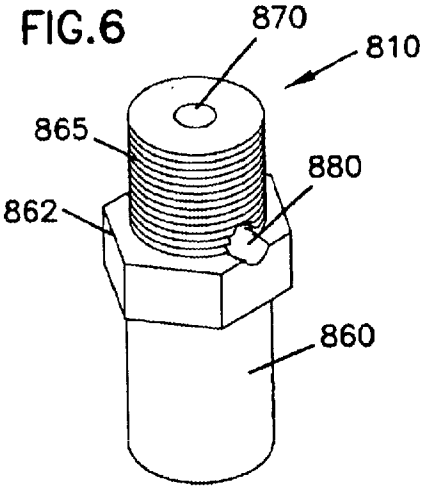
FIG. 6 is a perspective view of the example embodiment of the mixture fitting of FIG. 2 shown in isolation.
Figure 10:
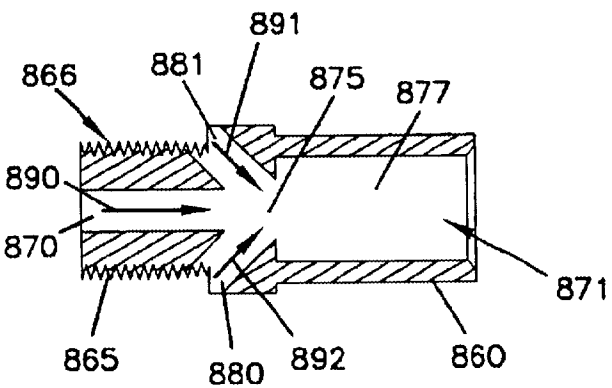
FIG. 10 is a cross-sectional view taken along line A—A of the example embodiment of the mixture fitting shown in FIG. 9.
Figure 9:
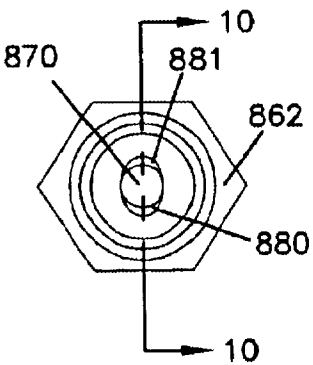
FIG. 9 is a second end view of the example embodiment of the mixture fitting shown in FIG. 6.
Figure 8:
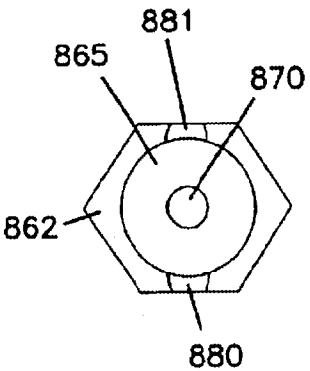
FIG. 8 is a first end view of the example embodiment of the mixture fitting shown in FIG. 6.
Figure 11:
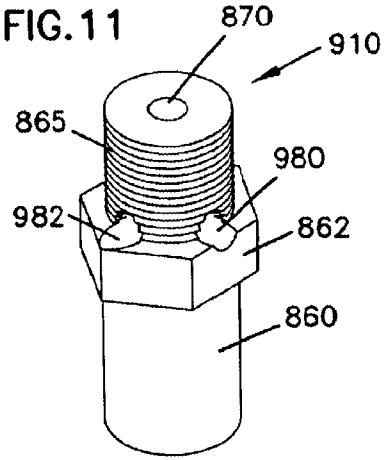
FIG. 11 is a perspective view of a second example embodiment of a mixture fitting made in accordance with the present invention.
Figure 12:
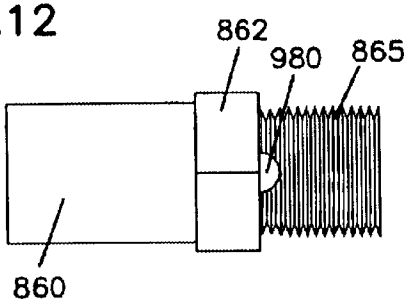
FIG. 12 is a side view of the example embodiment of the mixture fitting of FIG. 11.
Figure 13:
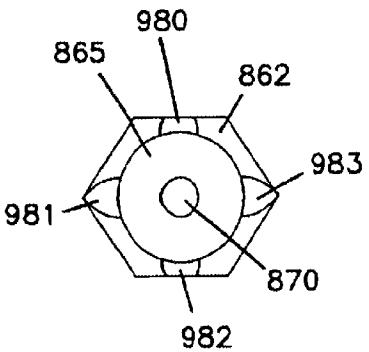
FIG. 13 is a first end view of the example embodiment of the mixture fitting shown in FIG. 11.
Figure 14:
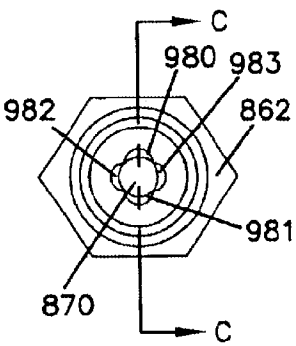
FIG. 14 is a second end view of the example embodiment of the mixture fitting shown in FIG. 11.
Figure 15:
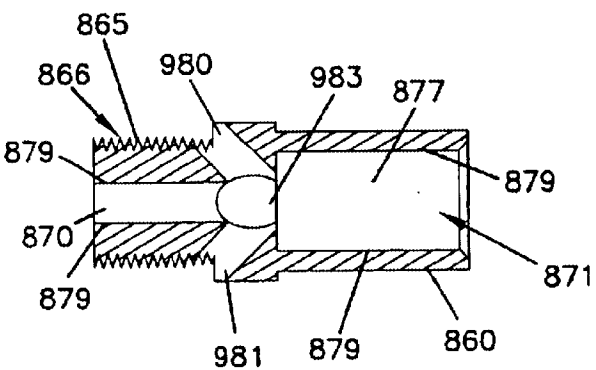
FIG. 15 is a cross-sectional view taken along line B—B of the example embodiment of the mixture fitting shown in FIG. 14.

Referring now to FIG. 1, a perspective view of an example embodiment of a fireplace 100 is shown. The fireplace 100 includes a combustion chamber enclosure 201. The combustion chamber enclosure 201 comprises panels 212, 216, and 282 (one or more additional panels that comprise example combustion chamber enclosure 201 are not shown in FIG. 1) that together define a combustion chamber 130. The combustion chamber enclosure 201 further defines an opening 110 that may optionally be covered by a panel 244. The fireplace 100 may generally function to ignite combustible gas provided from a combustible gas source to create a gas flame.

The panels 212, 216, 244, and 282 comprising the fireplace 100 are shown in one configuration. Other configurations are also possible. For example, the present invention may be applicable to any prefabricated gas fireplace such as a direct vent, a universal vent, a B-vent, a horizontal/vertical-vent, a dual direct vent, or a multisided unit. The present invention may also be applicable to other combustible gas burner systems other than a fireplace, as noted above.

Referring now to FIGS. 2–5, an example embodiment of a valve assembly 200 and a burner assembly 300 are shown. The valve assembly 200 and the burner assembly 300 may be utilized in conjunction with the fireplace 100 to delivery and ignite combustible gas to create a gas flame. The valve assembly 200 includes a variable valve 821 that functions to adjust an amount and pressure of combustible gas provided to the burner assembly 300. A flex piping 822 is coupled via a brass fitting assembly 802 to a first end of the variable valve 821. A flex ball valve assembly 808 is coupled to a second end of the variable valve 821. The flex ball valve assembly 808, in turn, can be connected to a source of combustible gas such as, for example, LP or natural gas, or mixtures thereof with air. A compression elbow fitting 803 is coupled on a first end via a brass fitting 801 and a grommet 804 to the flex piping 822.

The burner assembly 300 generally includes a burner 301 comprising a burner pan 703 coupled to a burner top 709. The burner top 709 includes apertures 711 defined through the burner top 709 in a predetermined pattern. This predetermined pattern may be modified to alter the characteristics of the flame pattern resulting from combustion. As shown in FIG. 1, the burner top 709 forms a portion of panel 216 of combustion chamber 201 of fireplace 100. Alternatively, a burner top can form an entire bottom panel of a combustion chamber enclosure and be composed of any material such as metal or a vacuum or compression molded refractory ceramic fiber material.

Other components of the burner assembly 300 include a burner deflector 704, a burner diffuser 706, and a burner support 705 disposed within the burner pan 703. A pilot assembly bracket 814 and electronic pilot 809 are disposed adjacent the burner top 709 to cause ignition of the combustible gas escaping from the apertures 711. A pair of burner legs 708 supports the burner pan 703 and related structures. A burner tube 707 is positioned below the burner pan 703. A first end 720 of the burner tube 707 is coupled to the burner pan 703 at an aperture 710 defined in the burner pan 703. An air shutter 701 with slots 746 is coupled to a second end 730 of the burner tube 707. Longitudinal slots 745 formed in the burner tube 707 correspond to the slots 746 formed in the air shutter 701, allowing for secondary air to enter through a space 747 into the tube 707 and mix with the gas, as described in detail below.

It is preferable in a combustible gas burner system to have a mixture consisting of given quantity of air and fuel to create desired efficiencies in combustion. For example, in the example embodiments shown, it is desirable to have approximately a 10 to 1 mixture of air to gas during combustion. In addition, it is preferable to assure a generally consistent mixture of air and gas to promote efficient combustion.

The valve assembly 200 is coupled to the burner assembly 300 as follows. The compression elbow fitting 803 of the valve assembly 200 is coupled to the air shutter 701 of the burner assembly 300 through a first example embodiment of a mixture fitting 810 made in accordance with the present invention. The example mixture fitting 810, shown in isolation in FIGS. 6–10, includes a first portion 865 defining a first gas passage 870 and a second portion 860 defining a second gas passage 877 of an increased diameter. The first gas passage 870 and the second gas passage 877 form a gas passage 871. Optionally, the first portion 865 can be threaded for coupling to the compression elbow fitting 803. Alternatively, the mixture fitting can be welded or otherwise connected to the compression elbow fitting. Positioned between and coupling the first portion 865 and the second portion 860 is a hex portion 862. The first gas passage 870 is fluidly coupled to the second gas passage 877 through the aperture 875 defined in the hex portion 862. In this configuration, the first portion 865 can be coupled to the compression elbow fitting 803 and the second portion 860 can be coupled to the air shutter 701.

Also formed in the first portion 865 are two example air orifices 880 and 881 that extend from an exposed surface 866 of the first portion 865 through to the gas passage 870. The exposed surface 866 may be any surface of the mixture fitting 810 that is exposed to air. The air orifices 880 and 881 in the example embodiment are positioned on opposed sides of the first portion 865 and extend at an angle relative to a longitudinal axis 895 of the mixture fitting 810. The air orifices 880 and 881 angle towards the second portion 860 in a direction of gas flow as the air orifices extend from the surface 866 to the gas passage 870. In this configuration, the air orifices 880 and 881 allow primary air to aspirate through the orifices 880 and 881 and into the gas passage 871, as described in greater detail below.

The air orifices 880 and 881 are important to the overall efficiency of the valve and burner assemblies 200 and 300 in that aspirating the air through the air orifices breaks a boundary layer that may form along the walls that form the gas passage 871 and promotes a turbulent flow that facilitates the mixture of the combustible gas with the air. This may improve the overall efficiency of the fireplace. As gas flows through a tube, the gas closest to the edges of the tube approaches a velocity of zero to form the boundary layer. In the example embodiment, this boundary layer is positioned adjacent an outer diameter 879 of the gas passage 871 as combustible gas flows through the passage.

In the example embodiment, the velocity and pressure of the combustible gas flowing through the gas passage 871 creates a pressure gradient that allows for aspiration of primary air through air orifices 880 and 881 in a direction of arrows 891 and 892 and into the passage 871. The air orifices 880 and 881 function to allow primary air to enter the gas passage 871 adjacent to its outer diameter 879 and therefore through the boundary layer of gas formed at the outer diameter 879. The primary air functions to create turbulence and further mix the gas and air already contained in the gas passage 871. For example, the primary air may break up the gas in the boundary layer, thereby reducing the boundary layer and promoting a more consistent mixture of combustible gas and air as the gas and air mixture flows through the passage 871 to the burner assembly 300. Further, the primary air may cause turbulence, thereby facilitating the mixing of gas and air. In this manner, the example mixture fitting 810 can assure a more consistent mixture of combustible gas and air, thereby allowing for greater efficiency in combustion of the gas by the burner assembly 300.

The valve and burner assemblies 200 and 300 may function to deliver and combust the air-gas mixture as follows. Combustible gas from a combustible gas source is supplied via the flex ball valve assembly 808 to the variable valve 821. The variable valve 821 delivers the combustible gas through the flex piping 822 to the compression elbow fitting 803. The gas then flows through the example mixture fitting 810, in which primary air enters through the air orifices 880 and 881, breaking up the boundary layer of gas formed around the outer diameter 879 of the passage 871 and causing more turbulent flow to further facilitate the mixture of gas and air in the gas passage 871. The gas is then delivered through the air shutter 701 to the burner tube 707, and the slots 745 and 746 in the shutter 701 and the burner tube 707 allow secondary air to enter through the space 747 to provide additional air for combustion. The burner tube 707 then directs the combustible gas to the burner 301 of the burner assembly 300, where the combustible gas and air mixture is ignited and combustion occurs.

The primary air entering the mixture fitting 810 differs from the secondary air entering through the space 747 in that the primary air is provided at a sufficient velocity to promote mixing of the air and gas to create a more consistent mixture, while the secondary air is provided as an additional source of air for combustion.

A second example embodiment of a mixture fitting 910 made in accordance with the present invention is shown in FIGS. 11–15. The mixture fitting 910 is similar to that of mixture fitting 810, except that the mixture fitting 910 includes four air orifices. Air orifices 980 and 981 are positioned in an opposing fashion and air orifices 982 and 983 are also positioned opposing each other and 90-degrees away from the air orifices 980 and 981. In this configuration, air may enter each of the air orifices 980, 981, 982, and 983 to mix with the boundary layer formed on the outer diameter of the gas passage 871, thereby increasing air content, turbulent flow, and further optimizing the mixture of combustible gas and air.

Alternatively to the two example embodiments shown, one air orifice or greater than four air orifices may be used as desired. Each orifice can be a hole, slit, slot, have different sizes, include a mesh cover to keep particulates from entering the orifice, and, if multiple holes are employed, a pattern can be used. In addition, the air orifices can be angled (as illustrated in the example embodiments) or may be perpendicular to the longitudinal axis 895. Alternatively, the angle of the air orifices can be varied individually or as a group to create the desired efficiencies.

The air that passes through the air orifices can either be aspirated (as shown in the embodiment provided) or optionally force injected into the passage. If the air is forced into the mixing fitting, the air can be oxygenated or oxygen rich through the use of an oxygenator. The terms "provide" or "providing" are used herein to describe both aspiration of air as well as forced injection of air into the air orifices.

Figure 16:
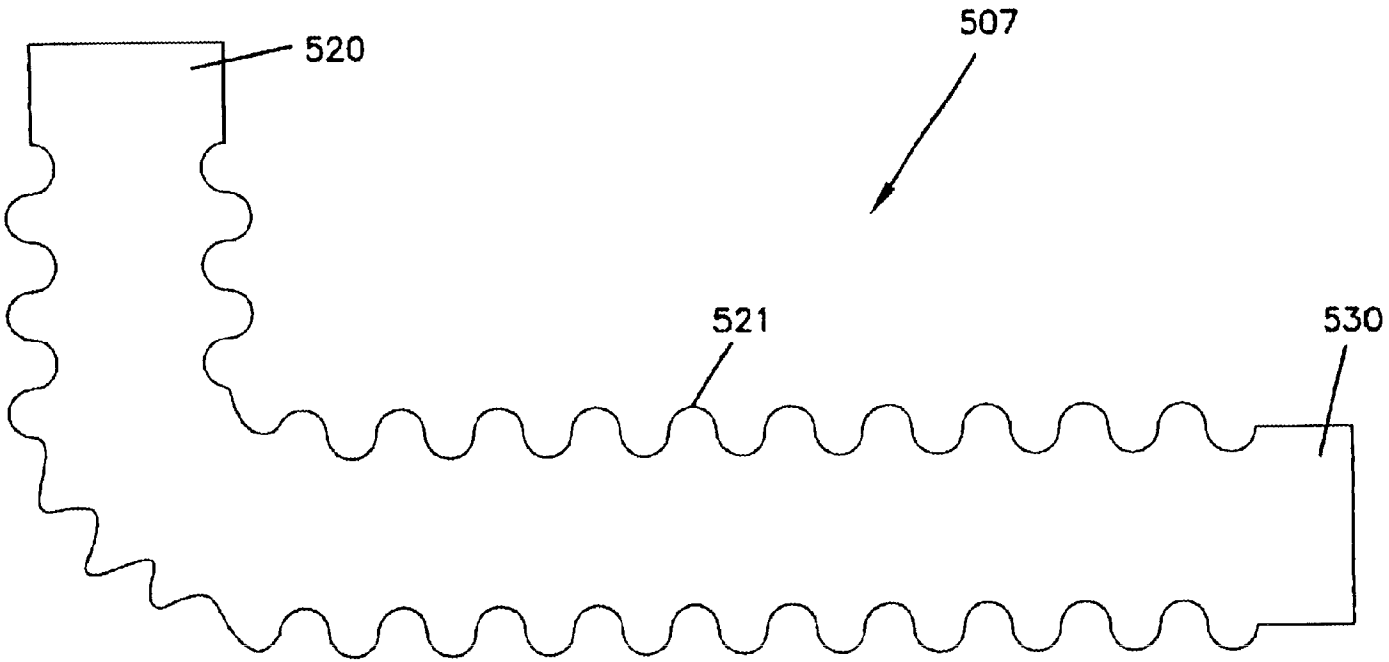
FIG. 16 is a side schematic cross-sectional view of a second example embodiment of a burner tube made in accordance with the invention.

An alternative example embodiment of a burner tube 507 made in accordance with the present invention is shown in FIG. 16. The burner tube 507 is similar to that of burner tube 707, except that the burner tube 507 includes a surface 521 extending from a first end 520 to a second end 530 of the burner tube 507. The surface 521 may be uneven, irregularly shaped, asymmetric, undulate, or otherwise vary. The configuration of the surface 521 of the burner tube 507 may be important because air traveling through the burner tube may laminate along a surface of the tube. The irregularly shaped surface of the burner tube 507 may function to facilitate further mixture of the air with the gas as both travel from the valve assembly 200 through the burner tube 507 to the burner 301. In this configuration, the burner tube 507 may function to deliver a gas-air mixture of a greater consistency, thereby creating greater efficiency when the gas-air mixture is combusted.

The surface 521 of the burner tube 507 may be evenly or unevenly varied to promote greater mixing. Other methods of promoting mixing can also be used, such as with additional variations in the diameter of the burner tube 507. For example, the burner tube 507 may be formed in an egg carton shape or a variety of other irregularly-shaped patterns to promote mixture of the air with the gas. Alternatively, the burner tube 507 may be configured as an insert for existing burner tubes. In this manner, the burner tube 507 could be inserted into existing burner tubes to facilitate in the mixing of gas and air as the air approaches the burner 301.

The example mixture fittings 810 and 910 and the burner tube 507 may function to increase efficiency of a system or apparatus that utilizes combustible gas to create a gas flame. First, the air orifices of the mixture fittings introduce additional air into the combustible gas, thereby optimizing the air and combustible gas mixture. Second, the angled position of the air orifices allows the air to be introduced adjacent an outer diameter of the gas passage, thereby mixing the boundary layer with air to reduce or eliminate it.

The present invention should not be considered limited to the particular examples or materials described above, but rather should be understood to cover all aspect of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. A gas fireplace comprising:

a combustion chamber enclosure defining a combustion chamber;

a burner assembly disposed within the fireplace, wherein the burner assembly includes:

a burner disposed to combust a combustible gas and air mixture within the combustion chamber, wherein the burner defines a burner tube aperture, a burner tube coupled to the burner tube aperture, and an air shutter coupled to the burner tube, wherein the air shutter defines an air aperture configured to deliver secondary air to the combustible gas and air mixture, and a mixture fitting aperture; and a mixture fitting defining a gas passage, and an air orifice extending from a first end at an outer surface of the mixture fitting to a second end at the gas passage, wherein combustible gas is delivered through the gas passage and mixed with primary air entering the gas passage through the air orifice to form the combustible gas and air mixture, wherein the mixture fitting is configured to deliver the combustible gas and air mixture to the burner through the burner tube, wherein the air orifice is oriented at an angle in a direction of a flow of the combustible gas within the gas passage such that the first end is positioned upstream of the flow of the combustible gas with resect to the second end of the air orifice, and when at least a portion of the mixture fitting is inserted into the mixture fitting aperture of the air shutter.

* * * * *